United States Patent [19]

Krieg et al.

[11] Patent Number: 5,050,386

[45] Date of Patent: Sep. 24, 1991

[54] METHOD AND APPARATUS FOR CONTAINMENT OF HAZARDOUS MATERIAL MIGRATION IN THE EARTH

[75] Inventors: Ronald K. Krieg, Blaine; John A. Drumheller, Issaquah, both of Wash.

[73] Assignee: RKK, Limited, Bellevue, Wash.

[21] Appl. No.: 560,147

[22] Filed: Jul. 31, 1990

Related U.S. Application Data

[63] Continuation-in-part of Ser. No. 392,941, Aug. 16, 1989, Pat. No. 4,974,425, which is a continuation-in-part of Ser. No. 281,493, Dec. 8, 1988, Pat. No. 4,860,544.

[51] Int. Cl.[5] ..... F17C 1/00

[52] U.S. Cl. ..... 62/45.1; 62/260; 165/45; 405/56; 405/130; 405/270

[58] Field of Search ..... 62/45.1, 260; 165/45; 405/130, 56, 270

[56] References Cited

U.S. PATENT DOCUMENTS

| | | | |
|---|---|---|---|
| 907,441 | 12/1908 | Baur . | |
| 2,159,954 | 5/1939 | Powell et al. | 61/36 |
| 2,865,177 | 12/1958 | Guaedinger | 61/36 |
| 3,183,675 | 5/1965 | Schroeder | 61/36 |
| 3,267,680 | 8/1966 | Schlumberger | 61/36 |
| 3,344,607 | 10/1967 | Vignovich | 61/5 |
| 3,350,888 | 11/1967 | Shrier | 61/36 |
| 3,707,850 | 1/1973 | Connell et al. | 62/45 |
| 3,915,727 | 10/1975 | Sparlin et al. | 106/123 |
| 3,934,420 | 1/1976 | Janelid et al. | 61/0.5 |
| 3,943,622 | 3/1976 | Ross | 61/36 A |
| 3,950,958 | 4/1976 | Loofbuorow | 62/45 |
| 3,986,339 | 10/1976 | Janelid | 62/45 |
| 4,030,307 | 6/1977 | Avedisian | 61/35 |
| 4,224,800 | 9/1980 | Grennard | 62/45 |
| 4,431,349 | 2/1984 | Coursen | 62/260 |
| 4,439,062 | 3/1984 | Kingsbury | 405/24 |
| 4,483,318 | 11/1984 | Margen | 62/260 |
| 4,538,673 | 9/1985 | Partin et al. | 165/45 |
| 4,597,444 | 7/1986 | Hutchinson | 166/302 |
| 4,607,488 | 8/1986 | Karinthi et al. | 62/45 |
| 4,632,604 | 12/1986 | McKelvy | 405/217 |
| 4,637,462 | 1/1987 | Grable | 166/245 |
| 4,676,694 | 6/1987 | Karinthi et al. | 405/130 |
| 4,723,876 | 2/1988 | Spalding et al. | 405/225 |

OTHER PUBLICATIONS

"Mitigative Techniques for Ground-Water Contamination Associated with Severe Nuclear Accidents", (NUREG/CR-4251, PNL-5461, vol. 1), pp. 4.103-4.110, 1985.

*Primary Examiner*—Ronald C. Capossela
*Attorney, Agent, or Firm*—Lahive & Cockfield

[57] ABSTRACT

A method and system is disclosed for reversibly establishing a closed, flow-impervious cryogenic barrier about a predetermined volume extending downward from a containment site on the surface of the Earth. An array of barrier boreholes extend downward from spaced apart locations on the periphery of the containment site. A flow of a refrigerant medium is established in the barrier boreholes whereby water in the portions of the Earth adjacent to the barrier boreholes freezes to establish ice columns extending radially about the boreholes. The lateral separations of the boreholes and the radii of the ice columns are selected so that adjacent ice columns overlap. The overlapping ice columns collectively establish a closed, flow-impervious barrier about the predetermined volume underlying the containment site. The system may detect and correct potential breaches due to thermal, geophysical, or chemical invasions. Also disclosed are a method and apparatus for reversibly freezing a predetermined volume extending downward from a containment site on the surface of the Earth and for establishing and removing cells within that volume. An array of heat transfer devices is established in a stick-like fashion in the volume for systematically freezing and unfreezing portions of the Earth adjacent to the heat transfer devices. One embodiment of the disclosed heat transfer devices includes at least one heat transfer rod extending radially outwardly from the heat transfer device into the predetermined volume for establishing a horizontal layer of frozen earth beneath the containment site.

24 Claims, 10 Drawing Sheets

METHOD AND APPARATUS FOR CONTAINMENT OF HAZARDOUS MATERIAL MIGRATION IN THE EARTH

REFERENCE TO RELATED APPLICATION

The present application is a continuation-in-part of U.S. Ser. No. 392,941 filed Aug. 16, 1989, "Closed Cyrogenic Barrier For Containment Of Hazardous Material Migration In The Earth" now U.S. Pat. No. 4,974,425 which is a continuation-in-part of U.S. Ser. No. 281,493, filed Dec. 8, 1988, "Closed Cryogenic Barrier for Containment of Hazardous Material Migration in the Earth" now U.S. Pat. No. 4,860,544.

BACKGROUND OF THE DISCLOSURE

The present invention is in the field of hazardous waste control and more particularly relates to the control and reliable containment of flow of materials in the Earth and to the removal of sections of the Earth which have been contaminated with hazardous waste.

Toxic substance migration in the Earth poses an increasing threat to the environment, and particularly to ground water supplies. Such toxic substance migration may originate from a number of sources, such as surface spills (e.g., oil, gasoline, pesticides, and the like), discarded chemicals (e.g., PCB's, heavy metals), nuclear accident and nuclear waste (e.g., radioactive isotopes, such as strontium 90, uranium 235), and commercial and residential waste (e.g., PCB's, solvents, methane gas). The entry of such hazardous materials into the ecosystem, and particularly the aquifer system, is well known to result in serious health problems for the general populace.

In recognition of such problems, there have been increasing efforts by both private environmental protection groups and governmental agencies, which taken together with increasing governmentally imposed restrictions on the disposal and use of toxic materials to address the problem of long term, or permanent, safe storage of hazardous wastes, and to clean up existing hazardous waste sites.

Conventional long term hazardous material storage techniques include the use of sealed containers located in underground "vaults" formed in rock formations, or storage sites lined with fluid flow-"impervious" layers, such as may be formed by crushed shale or bentonite slurries. By way of example, U.S. Pat. No. 4,637,462 discloses a method of containing contaminants by injecting a bentonite/clay slurry or "mud" into boreholes in the Earth to form a barrier ring intended to limit the lateral flow of contaminants from a storage site Among the other prior art approaches, U.S. Pat. No. 3,934,420 discloses an approach for sealing cracks in walls of a rock chamber for storing a medium which is colder than the chamber walls. U.S. Pat. No. 2,159,954 discloses the use of bentonite to impede and control the flow of water in underground channels and pervious strata. U.S. Pat. No. 4,030,307 also discloses a liquid-"impermeable" geologic barrier, which is constructed from a compacted crushed shale. Similarly, U.S. Pat. No. 4,439,062 discloses a sealing system for an earthen container from a water expandable colloidal clay, such as bentonite.

It is also known to form storage reservoirs from frozen earthen walls disposed laterally about the material to-be-stored, such as liquified gas. See, for example, U.S. Pat. No. 3,267,680 and 3,183,675.

While all of such techniques do to some degree provide a limitation to the migration of materials in the Earth, none effectively provide long term, reliable containment of hazardous waste. The clay, shale and bentonite slurry and rock sealant approaches, in particular, are susceptible to failure by fracture in the event of earthquakes or other earth movement phenomena. The frozen wall reservoir approaches do not address long term storage at all and fail to completely encompass the materials being stored. None of the prior art techniques address monitoring of the integrity of containment systems or of conditions that might lead to breach of integrity, or the correction of detected breaches of integrity.

Existing hazardous waste sites present a different problem. Many of them were constructed with little or no attempt to contain leakage; for example, municipal landfills placed in abandoned gravel pits. Furthermore, containment must either be in situ, or else the entire site must be excavated and moved. The primary current technology for in situ containment is to install slurry walls. However, that technique allows leaks under the wall; and through the wall when it cracks. Furthermore, slurry walls can only be installed successfully in a limited number of soil and rock conditions. Perhaps most importantly, there is no way to monitor when a slurry wall has been breached, nor is there any known ecconomical means to fix such a breach.

Another practical and legislatively required factor in the provision of effective toxic material containment, is the need to be able to remove a containment system. None of the prior art systems permit economic removal of the system once it is in place.

Moreover, in some circumstances, it is desirable to remove contaminated portions of the Earth for storage or remediation at other sites. Using conventional techniques, such earth portions are typically physically removed from the origin site with little or no effective treatment to prevent toxic material from becoming wind borne.

Accordingly, it is an object of the present invention to provide an improved hazardous waste containment method and system.

Another object is to provide an improved hazardous waste containment method and system that is effective over a long term.

Yet another object is to provide an improved hazardous waste containment method and system that is economic and efficient to install and operate.

Still another object is to provide an improved hazardous waste containment method and system that may be readily removed.

It is another object to provide an improved hazardous waste containment method and system that permits integrity monitoring and correction of potential short term failures before they actually occur.

It is yet another object to provide an improved hazardous waste containment method and system that is self-healing in the event of seismic events or earth movement.

Another object is to provide an improved method and system for removing contaminated portions of the Earth.

SUMMARY OF THE INVENTION

The present invention is adapted for use in several forms. In a "containment" form, the invention establishes a system for confining portions of the Earth in situ in a manner preventing migration of hazardous materials from those portions. In a "removal" form, the invention establishes an environmentally secure method and apparatus for cryogenically immobilizing hazardous materials in portions, or cells, of the Earth, and for removing those portions, for example, for subsequent storage or remediation.

In the containment form, the present invention is a method and system for reversibly establishing a closed cryogenic barrier confinement system about a predetermined volume extending downward from or beneath a surface region of the Earth, i.e., a containment site. The confinement system is installed at the containment site by initially establishing an array of barrier boreholes extending downward from spaced-apart locations on the periphery of the containment site. Then, a flow of refrigerant is established in the barrier boreholes. In response to the refrigerant flow in the barrier boreholes, the water in the portions of the Earth adjacent to those boreholes freezes to establish ice columns extending radially about the central axes of the boreholes. During the initial freeze-down, the amount of heat extracted by the refrigerant flow is controlled so that the radii of the ice columns increase until adjacent columns overlap. The overlapping columns collectively establish a closed barrier about the volume underlying the containment site. After the barrier is established, a lesser flow of refrigerant is generally used to maintain the overlapping relationship of the adjacent ice columns.

The ice column barrier provides a substantially fully impervious wall to fluid and gas flow due to the migration characteristics of materials through ice. In the event of loss of refrigerant in the barrier boreholes, heat flow characteristics of the Earth are such that ice column integrity may be maintained for substantial periods, typically six to twelve months for a single barrier, and one to two years for a double barrier. Moreover, the ice column barrier is "self-healing" with respect the fractures since adjacent ice surfaces will fuse due to the opposing pressure from the overburden, thereby re-establishing a continuous ice wall. The barrier may be readily removed, as desired, by reducing or eliminating the refrigerant flow, or by establishing a relatively warm flow in the barrier boreholes, so that the ice columns melt. The liquid phase water (which may be contaminated), resulting from ice column melting, may be removed from the injection boreholes by pumping.

In some forms of the invention, depending on sub-surface conditions at the containment site, water may be injected into selected portions of the Earth adjacent ot the barrier boreholes prior to establishing the refrigerant flow in those boreholes.

Where there is sub-surface water flow adjacent to the barrier boreholes prior to establishing the ice columns, that flow is preferably eliminated or reduced prior to the initial freeze-down. By way of example, that flow may be controlled by injecting material in the flow-bearing portions of the Earth adjacent to the boreholes, "upriver" side first. The injected material may, for example, be selected from the group consisting of bentonite, starch, grain, cereal, silicate, and particulate rock. The degree of control is an economic trade-off with the cost of the follow-on maintenance refrigeration required.

In some forms of the invention, the barrier boreholes are established (for example, by slant or curve drilling techniques) so that the overlapping ice columns collectively establish a barrier fully enclosing the predetermined volume underlying the containment site.

Alternatively, where a substantially fluid impervious sub-surface region of the Earth is identified as underlying the predetermined volume, the barrier boreholes may be established in a "picket fence" type configuration between the surface of the Earth and the impervious sub-surface region. In the latter configuration, the overlapping ice columns and the sub-surface impervious region collectively establish a barrier fully enclosing the predetermined volume underlying the containment site.

The containment system of the invention may further include one or more fluid impervious outer barriers displaced outwardly from the overlapping ice columns established about the barrier boreholes.

The outer barriers may each be installed by initially establishing an array of outer boreholes extending downward from spaced-apart locations on the outer periphery of a substantially annular, or circumferential, surface region surrounding the containment site.

A flow of a refrigerant is then established in these outer boreholes, whereby the water in the portions of the Earth adjacent to the outer boreholes freezes to establish ice colums extending radially about the central axes of the outer boreholes. The radii of the columns and the lateral separations of the outer boreholes are selected so that adjacent columns overlap, and those overlapping columns collectively establish the outer barrier. The region between inner and outer barriers would normally be allowed to freeze over time, to form a single composite, relatively thick barrier.

In general, refrigerant medium flowing in the barrier boreholes is characterized by a temperature T1 wherein T1 is below 0° Celsius. By way of example, the refrigerant medium may be brine at −10° Celsius, or ammonia at −25° Celsius, or liquid nitrogen at −200° Celsius.

The choice of which refrigerant medium to use is dictated by a number of conflicting design criteria. For example, brine is the cheapest but is corrosive and has a high freezing point. Thus, brine is appropriate only when the containment is to be short term and the contaminants and soils involved do not require abnormally cold ice to remain solid. For example, some clays require −15° Celsius to freeze. Ammonia is an industry standard, but is sufficiently toxic so that its use is contraindicated if the site is near a populace. The Freons are in general ideal, but are expensive. Liquid nitrogen allows a fast freezedown in emergency containment cases, but is expensive and requires special casings in the boreholes used.

In confinement systems where outer barriers are also used, the refrigerant medium flowing in the outer boreholes is characterized by a temperature T2, wherein T2 is below 0° Celsius. In some embodiments, the refrigerant medium may be the same in the barrier boreholes and outer boreholes and T1 may equal T2. In other embodiments, the refrigerant media for the respective sets of boreholes may differ and T2 may differ from T1. For example, T1 may represent the "emergency" use of liquid nitrogen at a particularly hazardous spill site.

In various forms of the invention, the integrity of said overlapping ice columns may be monitored (on a continuous or sampled basis), so that breaches of integrity, or conditions leading to breaches of integrity, may be detected and corrected before the escape of materials from the volume underlying the containment site. The integrity monitoring may include monitoring the temperature at a predetermined set of locations with or adjacent to the ice columns, for example, through the use of an array of infra-red sensors and/or thermocouples or other sensors. In addition, or alternatively, a set of radiation detectors may be used to sense the presence of radioactive materials.

The detected parameters for the respective sensors may be analyzed to identify portions of the overlapping columns subject to conditions leading to lack of integrity of those columns, such as may be caused by chemically or biologically generated "hot" spots, external underground water flow, or abnormal surface air ambient temperatures. With this gas pressure test, for example, it may be determined whether chemical invasion from inside the barrier has occurred, heat invasion from outside the barrier has occurred, or whether earth movement cracking has been healed.

In response to such detection, the flow of refrigerant in the barrier boreholes is modified whereby additional heat is extracted from those identified portions, and the ice columns are maintained in their fully overlapping state.

Ice column integrity may also be monitored by establishing injection boreholes extending downward from locations adjacent to selected ones of the barrier boreholes. In some configurations, these injection boreholes may be used directly or they may be lined with water permeable tubular casings.

To monitor the ice column integrity, prior to establishing the refrigerant flow, the injection boreholes are reversibly filled, for example, by insertion of a solid core. Then, after the initial freeze-down at the barrier boreholes, the fill is removed from the injection boreholes and a gaseous medium is pumped into those boreholes. The steady-state gas flow rate is then monitored. When the steady-state gas flow rate into one of the injection boreholes is above a predetermined threshold, then a lack of integrity condition is indicated. The ice columns are characterized by integrity otherwise. With this gas pressure test, for example, it may be determined whether chemical invasion from inside the barrier has occurred, heat invasion from outside the barrier has occured, or whether earth movement cracking has been healed.

When the barrier is first formed, this gas pressure test is used to confirm that the barrier is complete. Specifically, the overlapping of the ice columns is tested, and the lack of any "voids" due to insufficient water content is tested. Later, this gas pressure test is used to ensure that the barrier has not melted due to chemical invasion (which will not be detectable in general by the temperature monitoring system), particularly by solvents such as DMSO. Injection boreholes placed inside and outside the barrier boreholes can also be used to monitor the thickness of the barrier.

A detected lack of integrity of the overlapping ice columns may be readily corrected by first identifiying one of the injection boreholes for which said gas flow rate is indicative of lack of integrity of the overlapping ice columns, and then injecting hot water into the identified injection borehole. The hot water (which may be in liquid phase or gas phase) fills the breach in the ice columns and freezes to seal that breach.

Alternatively, a detected lack of integrity may be corrected by pumping liquid phase materials from the injection boreholes, so that a concentration of a breach-causing material is removed. A detected lack of integrity may also be corrected by modifying the flow of refrigerant in the barrier boreholes so that additional heat is extracted from the columns characterized by lack of integrity.

In the removal form of the invention, a system is provided for containing the migration of hazardous materials by reversibly freezing a predetermined volume of the Earth extending downward beneath a surface region and containing the hazardous materials. At least one cell of that volume may be removed.

In accordance with the invention, an array of elongated heat transfer devices is established extending downward from spaced apart locations throughout a surface region of the Earth. The array includes a first subset of heat transfer devices positioned to define the lateral surfaces of at least one cell underlying the surface region, and a second subset of heat transfer devices positioned at least within said cell. The heat transfer devices can be arranged so that the cells are substantially rectangular- or frustum-shaped.

A relatively low temperature is established on the outer surfaces of the second subset of heat transfer devices so that water in the portions of the Earth adjacent thereto freezes to establish ice columns extending axially along and radially about the central axes of the heat transfer devices. The position of the central axes, the radii of the columns, and the lateral separations of the heat transfer devices are selected so that adjacent columns overlap and collectively fill at least the periphery of the defined cells to establish frozen volume of earth therein.

For removing the cells from their in situ position, after the frozen volume of earth is established, a relatively high temperature is established on the surface of the heat transfer devices of the first subset, so that water in the portions of the Earth adjacent to these heat transfer devices, and along the lateral surfaces of the cells, is substantially unfrozen. The frozen cells can then be individually removed from the predetermined volume of earth by being lifted from their in situ position. This is achieved by applying a vertical force to lifting elements which have been inserted into the cell. Each lifting element includes a portion for receiving the vertical force and a portion for anchoring the element to the cell. The lifting elements will typically be screwed, threaded, driven, or pushed into the cells. A water spray can be applied to the lateral surfaces of the cells during removal to establish an ice glaze on the outer surface of the removed cell which will prevent hazardous material from becoming wind borne.

In another form of the invention, after being removed from the predetermined volume, each cell is positioned in a substantially flat bottomed container having liquid phase water therein. The water freezes to the bottom of the removed cell, and establishes a substantially flat bottom of the composite of the cell and the water. This flat bottom facilitates transportation of the removed cell.

In yet another form of the invention particularly adapted for dry portions of the Earth, an array of elongated heat transfer devices is established extending downward from spaced apart locations throughout a surface region of the Earth, as is done with the immediately above-discussed embodiment of the invention. The array includes a first subset of heat transfer devices positioned to define the lateral surfaces of at least one cell, which can be substantially rectangular- or frustum-shaped, and a second subset of heat transfer devices positioned at least within the cells. In this embodiment of the invention, however, a relatively low temperature is established on at least the lower portion of the outer surface of the heat transfer devices of the second set in order initially to establish, not a frozen column of earth, but a low temperature columnar region of earth which extends axially along and radially about the central axes of the heat transfer devices of the second set. The radii of the columnar regions and the lateral separations of the heat transfer devices are selected so that adjacent low temperature columnar regions overlap to collectively fill at least the periphery of the defined cells to establish a low temperature composite volume of earth therein. A frozen volume of earth is established by then injecting water into selected portions of the Earth adjacent to the heat transfer devices.

By establishing a relatively high temperature on the surface of selected heat transfer devices of the first set, water injected in the portions of the Earth adjacent to these heat transfer devices, and along the lateral surfaces of a cell, is substantially unfrozen. This results in the cell being separable from the predetermined volume so that it can then be removed from the predetermined volume by lifting it from its in situ position. The maintenance of the high temperature may be accomplished before, during or after establishment of the columnar regions and injection of water.

In yet another aspect, the invention is an earth freezing apparatus suitable for use as the heat transfer devices for the above forms of the invention. The apparatus includes an elongated tubular element formed of a material of relatively high thermal conductivity and extending along a reference axis. A solid central core also having a relatively high thermal conductivity is disposed within the tubular element and defines a continuous, generally U-shaped central channel that extends from a proximal end of the tube. The channel is adapted to accommodate a flow of heat exchange fluid therethrough. The central core further defines at least one substantially uniform cross-section heat tranfer rod guide channel which extends along a guide axis. The guide axis of the guide channel is substantially parallel to the reference axis at a proximal end of the core and angularly offset with respect to the reference axis at an exit point at which the guide channel exits the central core. Preferably, the guide channels include a single bend adjacent to the exit point. The wallls of the guide channel are adapted to receive an elongated metal heat transfer rod which is inserted at the proximal end and passes through the guide channel along the guide axis. The rods are driven or screwed from the proximal end until the leading tip extends to a desired point outside the tubular element. Thus, a leading tip of the rod exits the central core at the exit point and, when the apparatus is placed in the Earth with the proximal end up, extends into the surrounding portions of the Earth in the direction of an axis which is offset from the reference axis.

In various other embodiments of the invention, the central core defines at least two, and preferably three or four, heat transfer rod guide channels. Typically, the guide channels have exit points which are offset from one another in the axial and radial directions.

Such devices may be used to establish each heat transfer device in the array of "second subset" heat transfer devices. When the array is in place, the earth surrounding the "second subset" heat transfer devices may be frozen by passing a cooled heat exchange fluid through the central channel and heat is extracted by that fluid via conduction through the central core from the outer surface of the tubular element and also from the rods, particularly to the portion of the rods extending from the exit port. In response to the heat so transferred, the earth interior to the cell boundaries is frozen. Then, after a heated heat exchange fluid is passed through the "first subset" heat transfer devices to define the cell boundaries, the cell may be readily lifted and removed from the Earth. the removed cell may be then stored and/or remediated at another location. Alternatively, the cell may be retained in its original position, thereby immobilizing any contaminants frozen therein.

The rod-bearing heat transfer devices may also be used as "second subset" heat transfer devices, where the rods are adapted to protrude into the Earth at cell boundaries.

An advantage to the removal form of the invention over the containment form is that of reduced capital outlay in situations where contamination is widespread but not deep. In fact, this is the typical scenario. The system allows migration of hazardous material to be immobilized and removed from a portion of a contaminated volume of the Earth, rather than requiring the entire volume to be contained all at once as is required in the full containment form. While total containment is the ultimate goal, the system allows containment to begin in areas of high contamination. As financing becomes increasingly available, the system can be expanded through the addition of more heat transfer devices.

In most prior usage of ground freezing, there has been strong economic incentive to freeze down the Earth quickly; for example, to allow construction of a building, dam, or tunnel to proceed. However, in the case of hazardous waste containment, the usual problem is the concern that the underground aquifer will eventually be contaminated, but the problem is not immediate. Significant economic savings can be obtained by allowing the initial freezedown to take a year or so to occur, since efficiency of the refrigeration process goes up significantly the slower the process is applied. In particular, the maintenance refrigeration equipment can be used to effect the freezedown rather than the usual practice of leasing special heavy duty refrigeration equipment in addition to the maintenance equipment.

If the installation is anticipated to be long-term, typically in excess of ten years, then several modifications will be considered.

First, the confinement system may be made fully or partially energy self-sufficient through the use of solar power generators positioned at or near the containment site, where the generators produce and store, as needed, energy necessary to power the various elements of the system. The match between the technologies is good, because during the day the electricity can be sold to the grid during peak demand, and at night during off-peak demand power can be brought back to drive the refrigeration units when the refrigeration process is most efficient.

Second, the compressor system may be replaced with a solid-state thermoelectric or magneto-caloric system, thereby trading current capital cost for long term reliability and significantly lower equipment maintenance.

Third, the freezing boreholes may be connected to the refrigeration units via a "sliding manifold" whereby any one borehole can be switched to any of a plurality of refrigeration units; thereby permitting another level of "failsafe" operation.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Embodiments of the "containment" form of the invention will first be described in conjunction with FIGS. 1–5 and then embodiments of the "removal" form of the invention will be described in conjunction with FIGS. 6–11.

Figure 1:
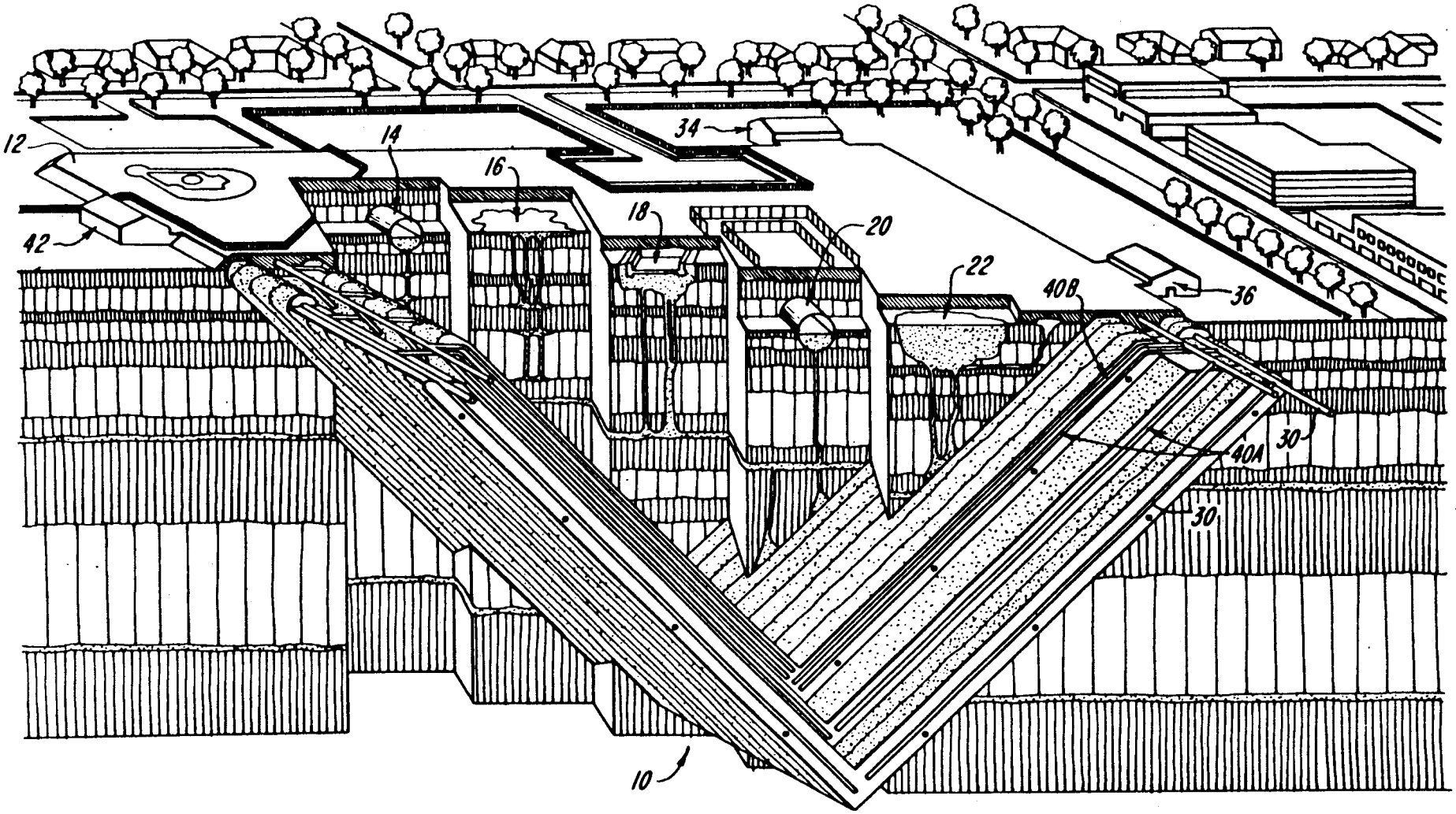
FIG. 1 shows a cut-away schematic representation of a confinement system in accordance with the present invention.

A cryogenic barrier confinement system 10 embodying the "containment" form of the invention is shown in FIG. 1. In that figure, a containment surface region of the Earth is shown bearing a soil cap layer 12 overlying deposits of hazardous waste material. In the illustrated embodiment, these deposits are represented by a leaking gas storage tank 14, a surface spill 16 (for example, gasoline, oil, pesticides), an abandoned chemical plant 18 (which, for example, may leak materials such as PCB's or DDT), a leaking nuclear material storage tank 20 (containing, for example, radioactive isotopes, such as strontium 90 or U-235) and a garbage dump 22 (which, for example, may leak leachite, PCB's and chemicals, and which may produce methane).

The confinement system 10 includes a barrier network 30 having a dual set of (inner and outer) cryogenic fluid pipes extending into the Earth from spaced apart locations about the perimeter of the containment surface underlying soil cap layer 12. In the preferred embodiment, the cap layer 12 is impervious to fluid flow and forms a part of system 10. With such a cap layer the enclosed volume does not overflow due to addition of fluids to the containment site. In the illustrated embodiment, the cryogenic fluid pipes extend such that their distal tips tend to converge at underground locations. In alternative embodiments, for example where there is a fluid flow-impervious sub-stratum underlying the containment site, the cryogenic fluid pipes may not converge, but rather the pipes may extend from spaced apart locations on the perimeter of the containment surface of that sub-stratum, establishing a "picket fence"-like ring of pipes, which together with the fluid flow-impervious sub-stratum, fully enclose a volume underlying the containment surface. In the illustrated embodiment, the cryogenic pipes extend downward from points near or at the Earth's surface. In alternate forms of the invention, these pipes may extend downward from points displaced below the Earth's surface (e.g., by 10–15 feet) so that the resulting barrier forms a cup-like structure to contain fluid flow therein, with a significant saving on maintenance refrigeration costs. In that configuration, fluid level monitors may detect when the cup is near filled, and fluid may be pumped out.

Figure 2:
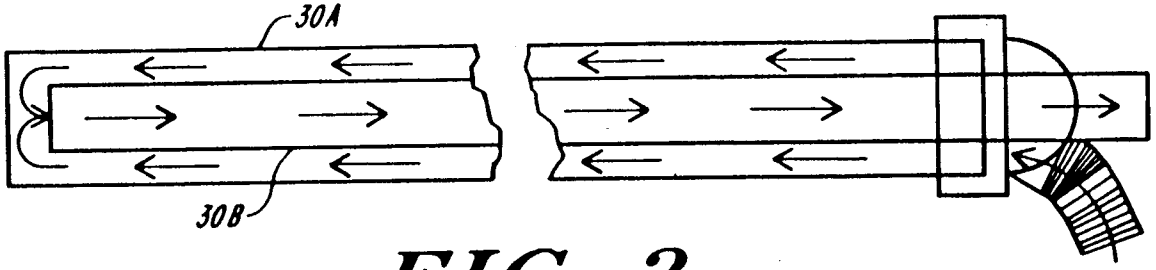
FIG. 2 shows in section, one of the concentric pipe units of the barrier network of the system of FIG. 1.

In the preferred embodiment, each of the pipes of network 30 is a two concentric steel pipe unit of the form shown in FIG. 2. In each unit, where the outer pipe 30A is closed at its distal end and the inner pipe 30B is open at its distal end and is spaced apart from the closed end of the outer pipe.

Two cryogenic pump stations 34 and 36 are coupled to the barrier network 30 in a manner establishing a controlled, closed circuit flow of a refrigerant medium from the pump stations, through the inner conduit of each pipe unit, through the outer conduit of each pipe unit (in the flow directions indicated by the arrows in FIG. 2), and back to the pump station. Each pump station includes a flow rate controller and an associated cooling unit for cooling regrigerant passing therethrough.

The confinement system 10 further includes an injection network 40 of water-permeable injection pipes extending into the Earth between the inner and outer sets of barrier pipes of network 30 (exemplified by pipe 40A in FIG. 1) and adjacent to the pipes of the network 30 (exemplified by pipe 40B in FIG. 1). In other forms of the invention, the pipes of injection network 40 may be replaced by simple boreholes (i.e. without a pipe structure).

A water pumping station 42 is coupled to the injection network 40 in a manner establishing a controlled flow of water into the injection pipes of network 40.

A first set of sensors (represented by solid circles) and a second set of sensors (represented by hollow rectangles) are positioned at various points near the pipes of barrier network 30. By way of example, the sensors of the first set may be thermocouple-based devices and the sensors of the second set may be infrared sensors or, alternatively may be radio-isotope sensors. In addition, a set of elevated infrared sensors are mounted on poles above the containment site. The sub-surface temperature may also be monitored by measuring the differential heat of the inflow-outflow at the barrier boreholes and differential heat flow at the compressor stations.

In order to install the system 10 at the site, following analysis of the site sub-surface conditions, a set of barrier boreholes is first established to house the pipes of network 30. The placement of the barrier boreholes is a design tradeoff between the number of boreholes (in view of cost) and "set-back" between the contaminant-containing regions and the peripheral ring of barrier boreholes. The lower set-back margin permits greater relative economy (in terms of installation and maintenance) and larger set-back permits greater relative safety (permitting biological action to continue) and permits use of other mitigation techniques.

The boreholes may be established by conventional vertical, slant or curve drilling techniques to form an array which underlies the surface site. The lateral spacing of the barrier boreholes is determined in view of the moisture content, porosity, chemical, and thermal characteristics of the ground underlying the site, and in view of the temperature and heat transfer characteristics of regrigerant medium to be used in those boreholes and the pipes.

Passive cooling using thermal wicking techniques may be used to extract heat from the center of the site, thus lowering the maintenance refrigeration requirements. In general, such a system consists of a closed refrigerant system consisting of one or more boreholes placed in or near the center of the site connected to a surface radiator via a pump. The pump is turned on whenever the ambient air is colder than the Earth at the center of the site. If the radiator is properly designed, this system can also be used to expel heat by means of black body radiation to the night sky.

In the illustrated embodiment, sub-surface conditions indicate that addition of water is necessary to provide sufficient moisture so that the desired ice columns may be formed for an effective confinement system. To provide that additional sub-surface water, a set of injection boreholes is established to house the water permeable injection pipes of network 40. The injection boreholes also serve to monitor the integrity of the barrier by means of the afore-described gas pressure test.

Following installation of the networks 30 and 40, the pump station 42 effects a flow of water through the injection pipes of network 40 and into the ground adjacent to those pipes. Then the refrigerant pump stations 34 and 36 effect a flow of the refrigerant medium through the pipes of network 30 to extract heat at a relatively high start-up rate. That refrigerant flow extracts heat from the sub-surface regions and adjacent to the pipes to establish radially expanding ice columns about each of the pipes in network 30. This process is continued until the ice columns about adjacent ones of the inner pipes of network 30 overlap to establish an inner closed barrier about the volume beneath the site, and until the ice columns about adjacent ones of the outer pipes of network 30 overlap to form an outer closed barrier about that volume. Then, the refrigerant flow is adjusted to reduce the heat extraction to a steady-state "maintenance" rate sufficient to maintain the columns in place. However, if the "start-up" is slow to enhance the economics and is done in winter, the "maintenance" rate in summer could be higher than the startup rate.

With the barriers established by the overlapping ice columns of system 10, the volume beneath the containment site and bounded by the barrier provides an effective seal to prevent migration of fluid flow from that volume.

With the dual (inner and outer) sets of pipes in network 30 of the illustrated embodiment, the system 10 establishes a dual (inner and outer) barrier for containing the flow of toxic materials.

Figure 5:
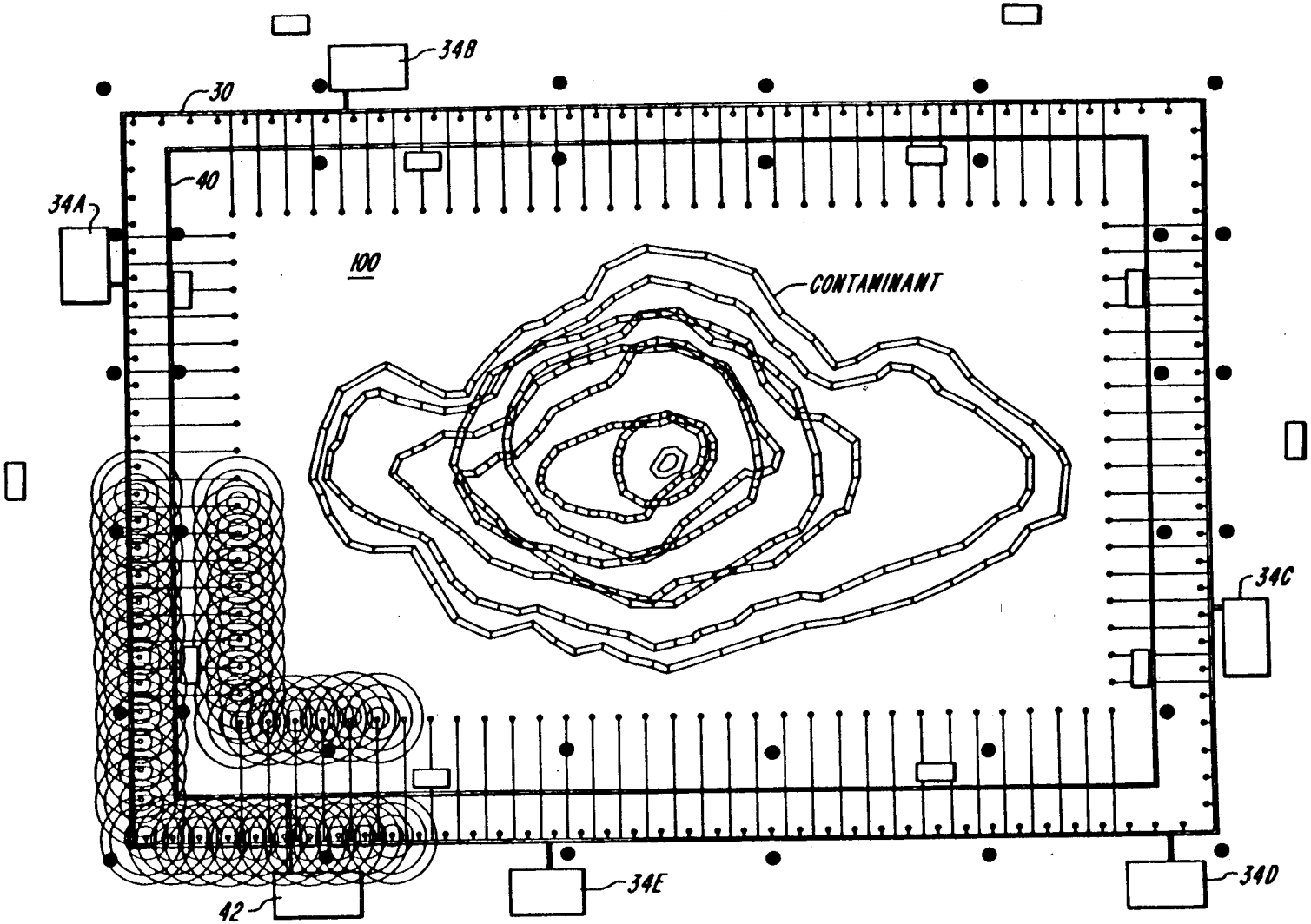
FIG. 5 shows a top elevation view of the cryogenic barrier confinement system of FIG. 4.

The network 30, as shown in FIG. 5, includes a set of barrier boreholes extending downward from locations on the periphery of a rectangular confinement surface region of the Earth, and a set of outer boreholes extending downward from locations on the periphery of rectangle-bounded circumferential surface region surrounding that confinement surface region. The central axes of the boreholes in the illustrated example extend along substantially straight lines. Moreover, the outer boreholes of the principal portions of the set are positioned to be substantially equidistant from the two nearest boreholes of the barrier set, leading to a configuration requiring a minimum of energy to establish the overlapping ice columns forming the respective barriers.

In an alternate configuration, the contiguous boreholes of the barrier set (and of the outer set, in a double barrier configuration) may each extend along the peripheries of the respective surface regions, but with a zig-zag pattern (i.e. alternately on one side and then the other) along the peripheries. Preferably, the extent of zig-zag is less than about ten percent relative to the inter-barrier spacing. With the zig-zag configuration, as the ice columns extend to the point of overlapping, the alternating refrigerant pipes for the respective columns are allowed to be displaced slightly in opposite directions perpendicular to the local portion of the periphery, thereby minimizing stress on those pipes. In contrast, where the pipes are strictly "in line", there is a high degree of pressure placed on the pipes as the columns begin to overlap. With the zig-zag configuration, the respective outer boreholes, as shown, are also considered to be substantially equidistant (except for the relatively minor variance due to the zig-zag) from their two nearest neighbor barrier boreholes.

Other configurations might also be used, such as a single pipe set configuration which establishes a single barrier, or a configuration with three or more sets of parallel pipes to establish multiple barriers. As the number of pipe sets, and thus overlapping ice column barriers, increases, the reliability factor for effective containment increases, particularly by heat invasion from outside. Also, a measure of thermal insulation is attained between the containment volume and points outside that volume. One characteristic of the cryogenic barrier established by the invention is that the central portion (i.e. near the refrigerant) may be maintained at a predetermined temperature (e.g. −37 degrees Celcius) by transferring heat to the refrigerant, while the peripheral portion of the barrier absorbs heat from the adjacent unfrozen soil. In some embodiments, the various ice column barriers may be established by different refrigerant media in the separate sets of pipes for the respective barriers. The media may be, for example, brine at −10° Celsius, Freon−13 at −80° Celsius, ammonia at −25° Celsius, or liquid nitrogen at −200° Celsius. In most practical situations, the virtually complete containment of contaminants is established where a continuous wall of ice is maintained at −37° Celsius or colder. At temperatures warmer than that, various contaminants may diffuse into the barriers, possibly leading to breaches.

In practice, the ice column, radii may be controlled to establish multiple barriers or the multiple barriers may be merged to form a single, composite, thick-walled barrier, by appropriate control of the refrigerant medium. In order to maintain separate inner and outer barriers, it is generally necessary to space the barriers so that their respective sets of central axes are laterally displaced by at least approximately 50 feet. In this configuration, the central axes of the barrier boreholes may be considered to define a first mathematical reference surface, and the central axes of the outer boreholes define a second mathematical reference surface. With these definitions, along mathematical reference planes passing through the central axes of the barrier boreholes and the central axes of the outer boreholes, the reference planes intersect the first reference surface along a closed, continuous piecewise linear first curve, and the reference planes intersect the second reference surface along a closed, continuous piecewise linear second curve, wherein the second curve is larger than and exterior to the first curve, the curves being laterally separated by at least approximately 50 feet. As a practical matter, refrigerant characteristics will not provide sufficient cooling of the Earth to permit the barriers to merge at that separation.

On the other hand, when it is desired to establish a composite barrier (formed by merged inner and outer barriers), the string of central axes for the respective barriers should be separated by less than approximately 35 feet. In this configuration, the central axes of the barrier boreholes may be considered to define a first mathematical reference surface, and the central axes of the outer boreholes define a second mathematical reference surface. With these definitions, along mathematical reference planes passing through the central axes of the barrier boreholes and the central axes of the outer boreholes, the reference planes intersect the first reference surface along a closed, continuous piecewise linear first curve, and the reference planes intersect the second reference surface along a closed, continuous piecewise linear second curve, wherein the second curve is larger than and exterior to the first curve, the curves being laterally separated by less than approximately 35 feet. As a practical matter, refrigerant characteristics will generally provide sufficient cooling of the Earth to permit the barriers to merge at that separation.

With a thick walled barrier, as may be established by controlling refrigerant flow so that the ice columns from adjacent barriers merge (i.e. overlap), the resultant composite barrier may be maintained so that its central region (i.e. between the sets of inner and outer boreholes) is at a predetermined temperature, such as the optimum temperature −37° Celcius. Once this temperature is established in that central region, the refrigerant flow may be controlled so that the average barrier width remains substantially constant. For example, the flow may be intermittent so that during the "on" time the barrier tends to grow thicker and during the "off" time, the barrier tends to grow thinner due to heat absorption from earth exterior to the composite barrier. However, during this "off" time, the region between the inner and outer boreholes tends to remain substantially at its base temperature since little heat is transferred to that region. By appropriately cycling the on-off times, the average width is held substantially constant.

In contrast, with intermittent refrigerant flow in a single barrier system, during the "off" time the barrier not only grows thinner, but the peak (i.e. minimum) temperature also rises from its most cold value. As a result, to ensure barrier integrity at the peak allowed temperature, the single barrier must be at a colder start temperature prior to the "off" cycle, leading to higher energy usage compared to a double/composite barrier configuration.

In various environments, the order of establishment at the barriers in a two (or more) barrier system may be important to maximize confinement of hazardous materials. For example, to optimize confinement in earth formations of rock with cells or pockets, or basalt, or other forms of lava rock, it is important to first establish the inner and outer boreholes (in any order) followed first by controlling refrigerant flow in the outer boreholes to cool the adjacent rock to −37° Celcius or colder. Then, water may be added to the rock between the sets of boreholes, and finally refrigerant is controlled to flow in the inner boreholes to then cool the freeze the water in the rock adjacent to those inner boreholes. With that sequence, the rock surrounding the outer boreholes is cooled so that any water-born contaminants reaching those rocks are immediately frozen in place.

The ice column barriers are extremely stable and particularly resistant to failure by fracture, such as may be caused by seismic events or earth movement. Typically, the pressure from the overburden is effective to fuse the boundaries of any cracks that might occur; that is, the ice column barriers are "self-healing".

Breaches of integrity may also be repaired through selective variations in refrigerant flow, for example, by increasing the flow rate of refrigerant in regions where thermal increases have been detected. This additional refrigerant flow may be established in existing pipes of network 30, or in auxiliary new pipes which may be added as needed. The array of sensors may be monitored to detect such changes in temperature at various points in and around the barrier.

In the event the containment system is to be removed, the refrigerant may be replaced with a relatively high temperature medium, or removed entirely, so that the temperature at the barriers rises and the ice columns melt. To remove liquid phase water from the melted ice columns, that water may be pumped out of the injection boreholes. Of course, to assist in that removal, additional "reverse injection" boreholes may be drilled, as desired. Such "reverse-injection" boreholes may also be drilled at any time after installation (e.g. at a time when it is desired to remove the barrier).

In other forms of the invention, an outer set of "injection" boreholes might be used which is outside the barrier. Such boreholes may be instrumented to provide early and remote detection of external heat sources (such as flowing underground water).

Figure 3:
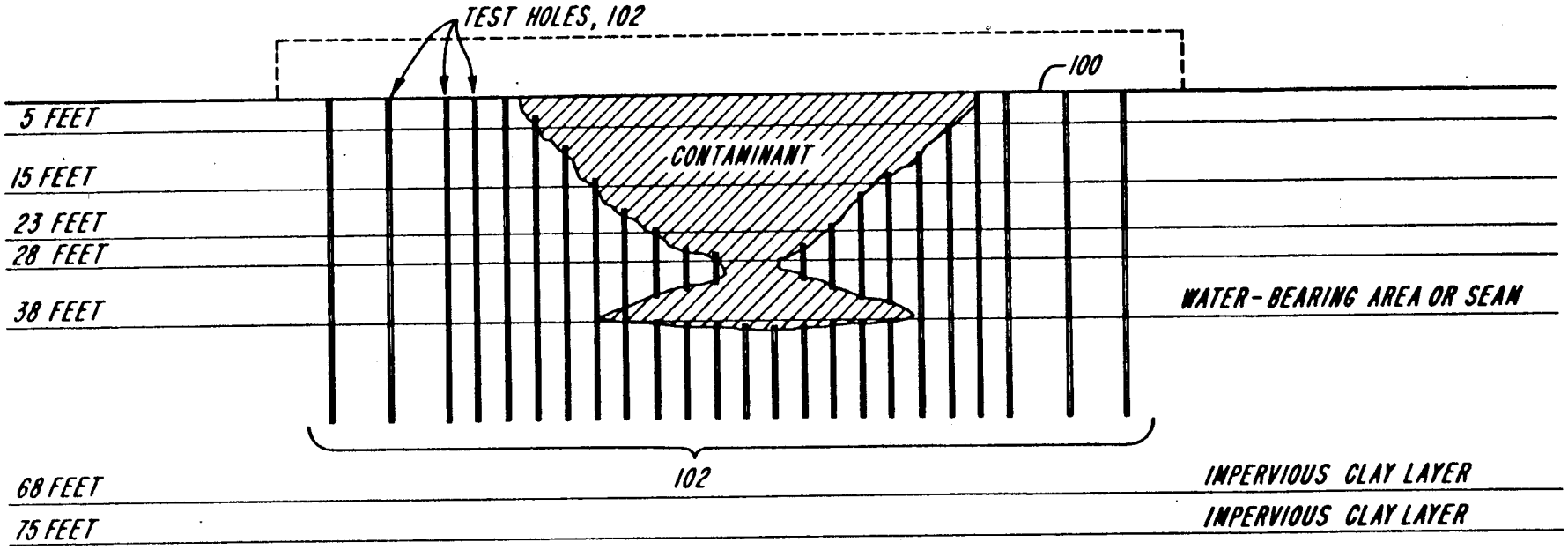
FIG. 3 shows in section an exemplary containment site overlying a volume containing a contaminant.

FIG. 3 shows a side view, in section, of the Earth at an exemplary, 200 foot by 200 foot rectangular containment site 100 overlying a volume bearing a containment. A set of vertical test boreholes 102 is shown to illustrate the means by which sub-surface data may be gathered relative to the extent of the sub-surface contaminant and sub-surface soil conditions.

Figure 4:
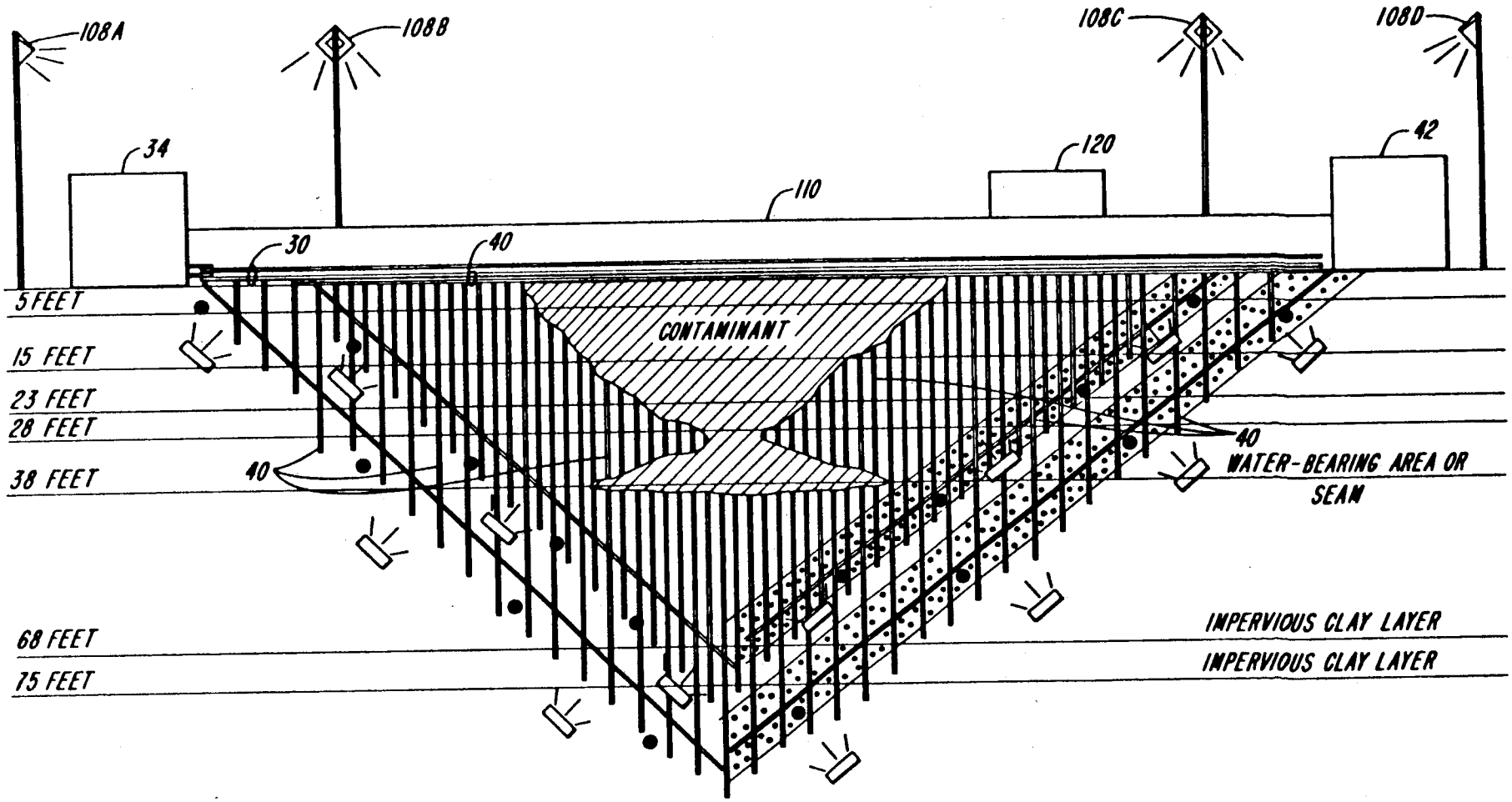
FIG. 4 shows in section an exemplary cryogenic barrier confinement system installed at the containment site of FIG. 3.

FIGS. 4 and 5 respectively show a side view, in section, and a top view, of the containment site 100 after installation of an exemplary cryogenic barrier confinement system 10 in accordance with the invention. In FIGS. 4 and 5, elements corresponding to elements in FIG. 1 are shown with the same reference designations.

The system 10 of FIGS. 4 and 5 includes a barrier network 30 having dual (inner and outer) sets of concentric, cryogenic fluid bearing pipes which are positioned in slant drilled barrier boreholes. In each pipe assembly which extends into the Earth, the diameter of the outer pipe is six inches and the diameter of the inner pipe is three inches. The lateral spacing between the inner and outer sets of barrier boreholes is approximately 25 feet. Four cryogenic pumps 34A, 34B, 34C and 34D are coupled to the network 30 in order to control the flow of refrigerant in that network. In the present configuration which is adapted to pump brine at −10° Celsius in a temperate climate, each cryogenic pump has a 500-ton (U.S. commercial) start up capacity (for freeze-down) and a 50-ton (U.S. commercial) long term capacity (for maintenance).

The system 10 also includes an injection network 40 of injection pipes, also positioned in slant drilled boreholes. Each injection pipe of network 40 extending into the Earth is a perforated, three inch diameter pipe.

As shown in FIG. 1, certain of the injection pipes (exemplified by pipe 40A) are positioned approximately mid-way between the inner and outer arrays of network 30, i.e., at points between those arrays which are expected to be the highest temperature after installation of the double ice column barrier. Such locations are positions where the barrier is most likely to indicate signs of breach. The lateral inter-pipe spacing of these injection pipes is approximately 20 feet. These pipes (type 40A) are particularly useful for injecting water into the ground between the pipes of networks 30 and 40.

Also as shown in FIG. 1, certain of the injection pipes (exemplified by pipe 40B) are adjacent and interior to selected ones of the pipes from network 30. In addition to their use for injecting water for freezing near the barrier borehole pipes, these injection pipes (type 40B) are particularly useful for the removal of ground water resulting from the melted columns during removal of the barrier. In addition, these "inner" injection boreholes may be instrumented to assist in the monitoring of barrier thickness, and to provide early warning of chemical invasion.

FIGS. 4 and 5 also show the temperature sensors as solid circles and the infra-red monitoring (or isotope monitoring) stations as rectangles. The system 10 also includes above-ground, infra-red monitors, 108A, 108B, 108C and 108D, which operate at different frequencies to provide redundant monitoring. A 10-foot thick, impervious clay cap layer 110 (with storm drains to resist erosion) is disposed over the top of the system 10. This layer 110 provides a thermal insulation barrier at the site. A solar power generating system 120 (not drawn to scale) is positioned on layer 110.

In FIG. 5, certain of the resulting overlapping ice columns (in the lower left corner) are illustrated by sets of concentric circles. In the steady state (maintenance) mode of operation in the present embodiment, each column has an outer diameter of approximately ten feet. With this configuration, an effective closed (cup-like) double barrier is established to contain migration of the containment underlying site 100. With this configuration, the contaminant tends to collect at the bottom of the cup-shaped barrier system, where it may be pumped out, if desired. Also, that point of collection is the most effectively cooled portion of the confinement system, due in part to the concentration of the distal ends of the barrier pipes.

Figure 6A:
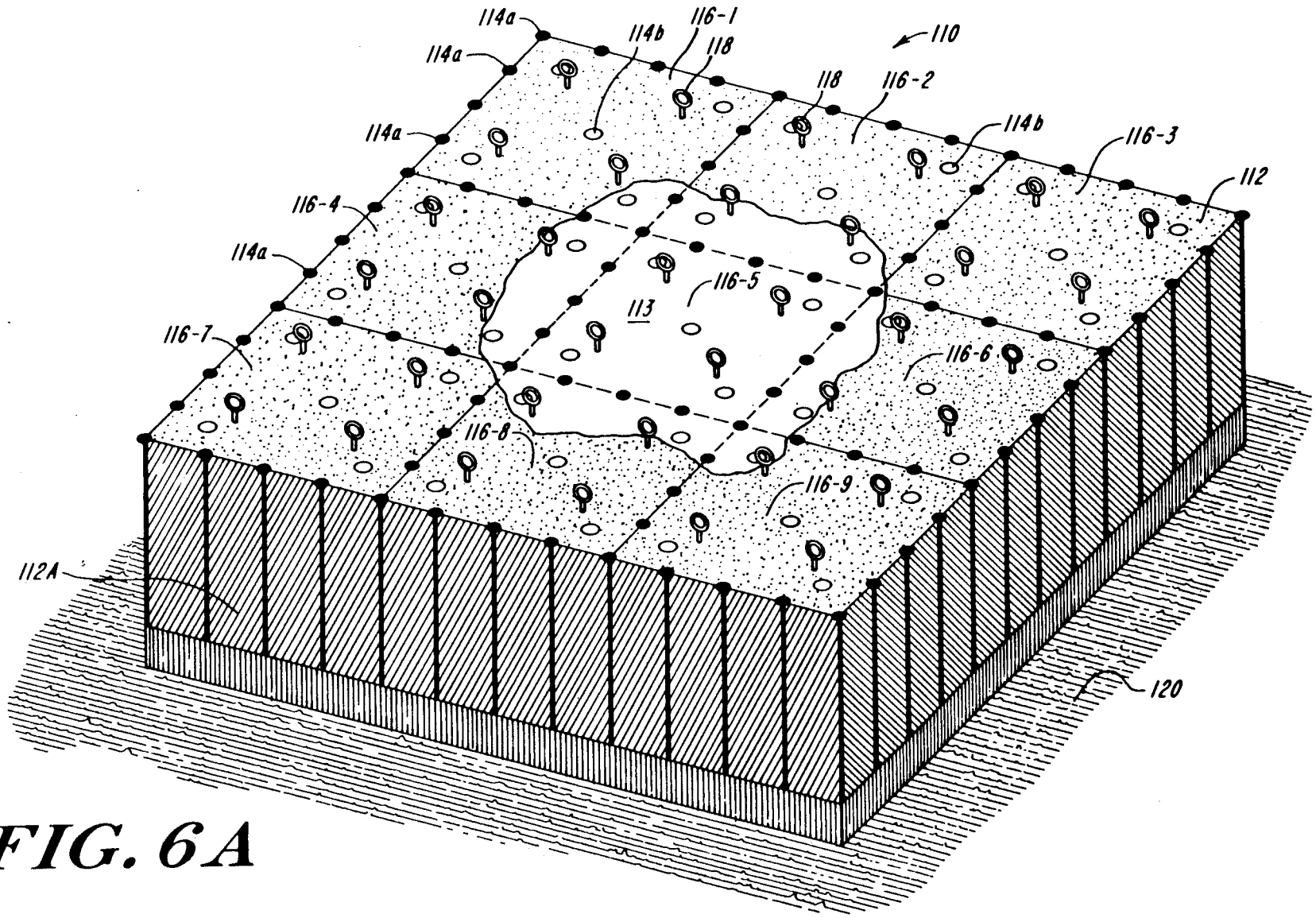
FIG. 6A is a cutaway perspective view of a portion of a removal system in accordance with the present invention.

A "removal" form of the invention is a system for reversibly freezing a predetermined volume of earth extending downward beneath a surface region of the Earth and for establishing and removing at least one cell within that volume. In this form, the invention provides not only a system for containment of hazardous material migration in the Earth, but also a system for removing the hazardous material from the containment site. An embodiment of this form of the invention, system 110, is shown in FIG. 6A with respect to a rectangular surface region 112 of the Earth and the right-prism shaped volume 112A extending downward from that surface region 112.

The system 110 includes an array of elongated heat transfer devices 114 extending from spaced apart locations of the surface region 112 and downward through the volume 112A. The heat transfer devices 114 are arranged as a first subset **114*a* and a second subset 114*b*. The heat transfer devices of the first subset 114*a* are arranged to define a 3×3 array of rectangular prism-shaped cells 116-1 through 116-9 within the predetermined volume 112A. The heat transfer devices of the second subset 114*b* are arranged at least within the cells 116. In FIG. 6A, the devices of the first set 114*a* are denoted by filled dot on surface 112 (and downward extending solid lines for devices at the lower and right portions of the perimeter of volume 112A); devices of the second subset 114*b* are indicated in FIG. 6 by hollow dots on surface 112**.

In use, the devices of subset **114*b* are used to freeze the surrounding regions of the Earth, while the devices of subset 114*a*** are used to maintain the surrounding regions of the Earth unfrozen, thereby establishing the cells are readily detachable (by lifting) from each other, and from the earth beneath the frozen cell, for removal.

In the illustrated system 110, the first subset heat transfer devices **114*a* extend vertically downward from surface region 112 in a stick-like manner such that their distal ends do not converge, thereby establishing substantially rectangular prism-shaped cells. Each cell may be removed independent of whether or not its neighbor cells have been removed. In the preferred form of the invention, the devices 114*a* may have the same form as the device shown in FIG. 2, and preferably may include a non-conductive extension at the lowermost end. The latter extension acts as an anchor for the devices 114*b*** when the cells defined by those devices are lifted from the Earth.

Figure 6B:
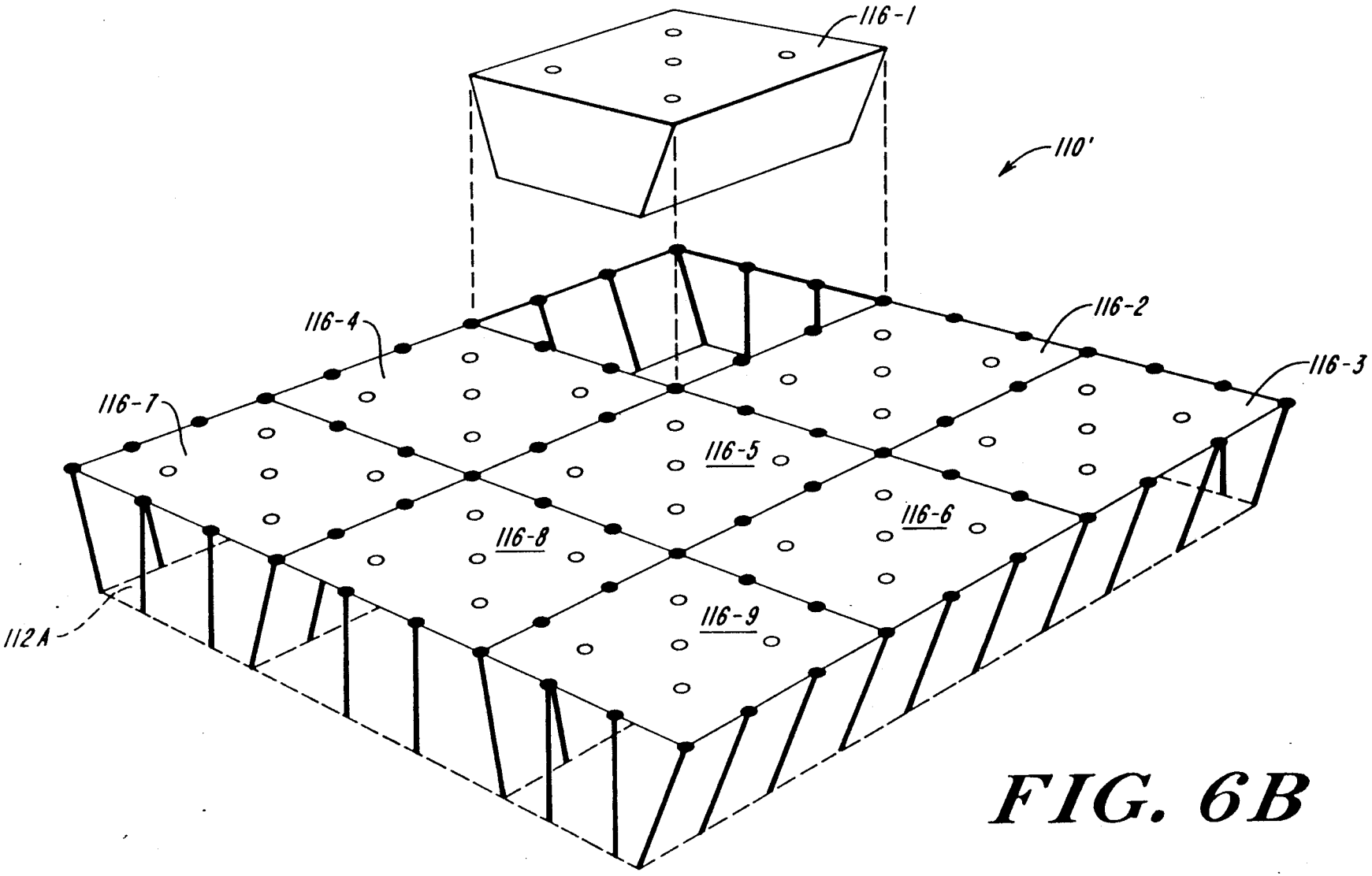
FIG. 6B is a schematic representation in perspective of an alternative form of the removal system of FIG. 6A.

In an alternative embodiment, such as the system 110' shown in FIG. 6B, the alternate rows of the subset **114*a* may be angularly offset in opposite directions from the vertical, thereby establishing frustum-shaped cells 116-1 through 116-9** where alternate rows of cells have their small base up while the remaining cells have their small base down. In still other embodiments, individual cells may be alternately inverted in a similar manner. In the latter embodiment, the cells having their larger base up are adapted for removal before the other cells.

In accordance with the operation of systems 110 and 110', a relatively low temperature is established on the outer surface of heat transfer devices **114*b* so that water in the portions of the Earth adjacent to the heat transfer devices 114*b* freezes to establish ice columns extending axially along and radially about the central axes of those heat transfer devices. The position of the central axes, the radii of the columns, and the lateral separations of heat transfer devices 114*b* are selected so that adjacent ice columns overlapping to collectively fill at least the periphery of each of the cells 116-1 through 116-9. In this manner, lateral migration of any hazardous material in the predetermined volume of earth occupied by the respective cells is prohibited. Typically, only heat transfer devices in the second subset 114*b* will be used for freezing. It is anticipated, however, that heat transfer devices of both first subset 114***a* and second subset 114*b* could be used interchangeably for freezing and thawing.

Vertical migration of hazardous material may be contained in several ways. As mentioned previously, where there is a fluid flow-impervious stratum underlying the predetemined volume, such as basalt layer 120 shown in FIG. 6A, no artificial steps need to be taken. Basalt layer 120 will naturally prevent the vertical migration of hazardous material. In the absence of such a layer, however, or where hazardous migration is to be contained at a shallower level than basalt layer 120, heat transfer device 114*b*, as shown in FIG. 7A, is able to establish a hard frozen zone across the lowermost boundary of a cell to prevent vertical migration below that level.

Figure 7A:
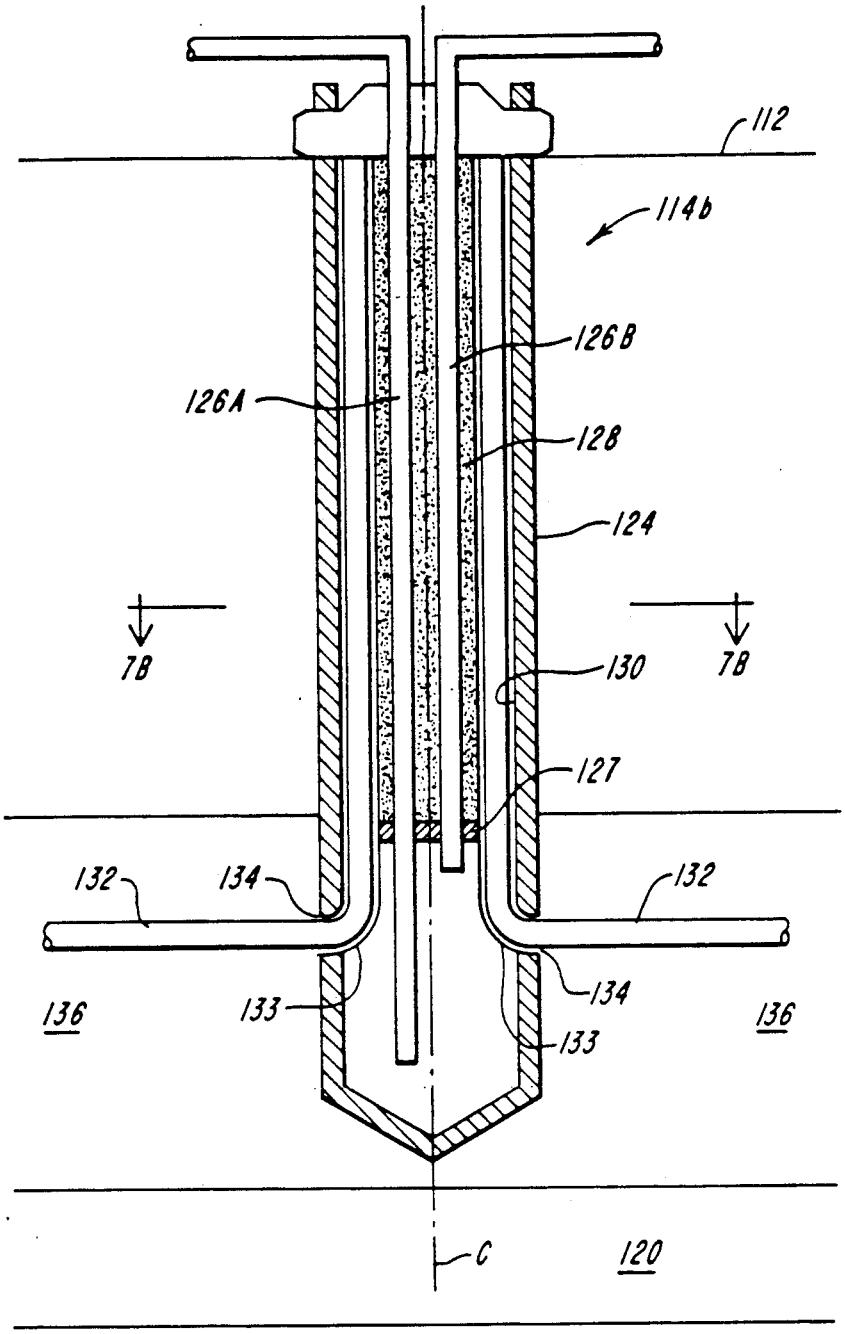
FIG. 7A is a schematic view in section of an illustration of a heat exchange device constructed in accordance with the present invention.

In FIG. 7A, heat transfer device 114*b* includes an outer casing 124, enclosing a generally high thermal conductivity, solid core 128. A generally U-shaped circulation channel 126 (comprising pipes 126A and 126B and a void region below seal 127) passes through core 128 from the proximal (upper) end and provides a flow path for a cooled heat exchange fluid, such as polyglycol. Other fluids might also be used. With this configuration, the heat exchange fluid in channel 126 is maintained at a desired temperature as it passes through channel 126 so that the outer surface of casing 124 is at the appropriate temperature to accomplish the freezing as desired in the regions of the Earth surrounding device 114. Of course, other methods for extracting heat from the Earth will be readily apparent to those ordinarily skilled in the art. It is important only that heat transfer device 114 include structure for withdrawing the desired heat from the area surrounding it.

For preferred embodiments of device 114 that are particularly adapted for use as second subset devices (114*a*), core 128 defines at least one heat transfer rod guide channel 130 for receiving a heat transfer rod 132. For the most part, heat transfer rod guide channel 130 travels through the core 128 along a guide axis G that is substantially parallel to a central axis C of heat transfer device 114. At its distal end, however, heat transfer rod guide channel 130 (and axis G) defines an elbow region 133 and an exit point 134 at which point heat transfer rod guide channel 130 (and axis G) is angularly offset from central axis C.

A heat transfer rod 132 passes through heat transfer rod guide channel 130 and exits in part from an exit point 134 of the heat transfer guide channel. In the preferred form of the invention, the rod 132 is made of a relatively soft or maleable metal, such as copper, and at least the elbow region 133 of channel 130 is made of a relatively hard metal, such as steel. With this configuration, rod 132 may be introduced to the top of channel 130 as a straight rod and then advanced through channel 126, being bent at the elbow region 133, until the distal portion extends outward from port 134. By way of example, rod 132 may be axially driven to achieve this configuration, or, alternatively, rod 132 and a portion of channel 130 above elbow region 133 may be threaded in a complimentary manner so that rod 132 may be advanced by rotating that rod about the upper end of axis G at the Earth's surface. Thus, heat transfer rod 132 may be driven or screwed into guide channel 130. In the case of rod 132 being driven, both heat transfer rod 132 and the inner walls of guide channel 130 will be smooth. In the case of rod 132 being screwed, heat transfer rod 137 will be threaded as will be a linear portion of guide channel 130 above elbow 133. Thus, in both cases, heat transfer rod 132 is formed of a material which has a high heat transfer coefficient and which is relatively maleable so that heat transfer rod 132 can be driven or screwed through heat transfer rod guide channel 130, around an elbow 133, and out exit point 134.

It is important that once heat transfer rod 132 bends to follow the path of heat transfer rod guide channel 130 and elbow 133, it extends outward from heat transfer device 114 substantially straight. In this manner, heat transfer device 114 can be utilized to freeze an area of the Earth 136 that extends out radially from heat transfer device 114. It has been found that copper is particularly well suited for this purpose. Of course, other commonly known malleable, thermally conductive materials can be used as well.

Figure 7B:
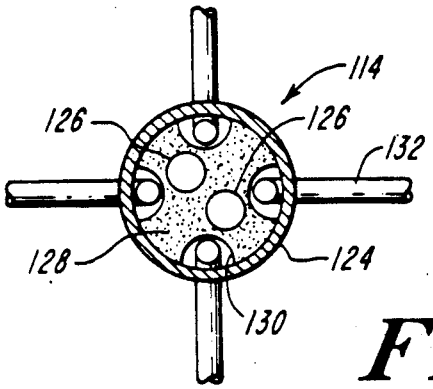
FIGS. 7B and 7C are top views of various embodiments of the heat exchange device of FIG. 7.
Figure 7C:
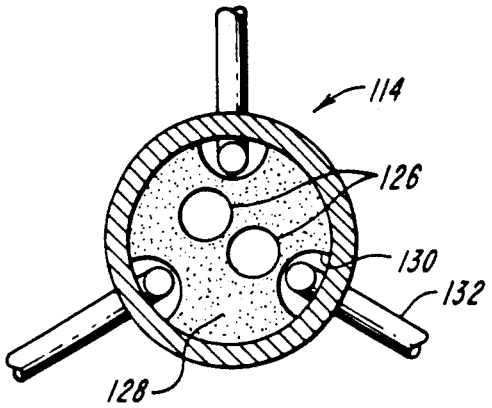

FIGS. 7B and 7C are top views of various embodiments of heat transfer device 114 of FIG. 7A. The distinction between the embodiments is the number of guide channels 130 and heat transfer rods 132. In the case of a system utilizing a heat transfer device having four heat transfer rods 132 as shown in FIG. 7B, the heat transfer devices will typically be arranged to provide heat extraction from the interior of the cells, in order to effectively establish a complete frozen layer within the contaminated volume of earth. FIG. 7C shows a heat transfer device having three heat transfer rods 132.

Figure 8A:
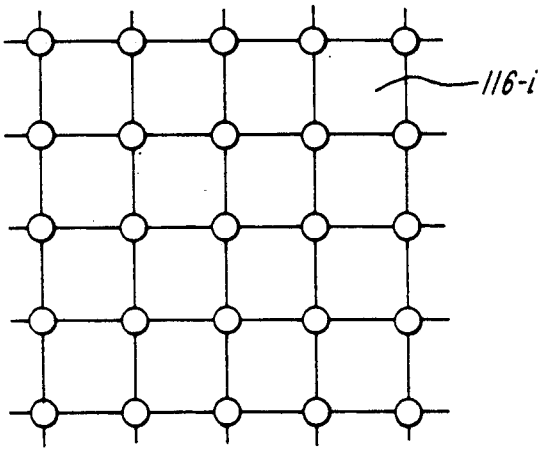
FIGS. 8A and 8B are respective schematic top views of the arrays of first subset heat exchange devices of a removal system utilizing the heat transfer devices of FIGS. 7B and 7C, respectively.
Figure 8B:
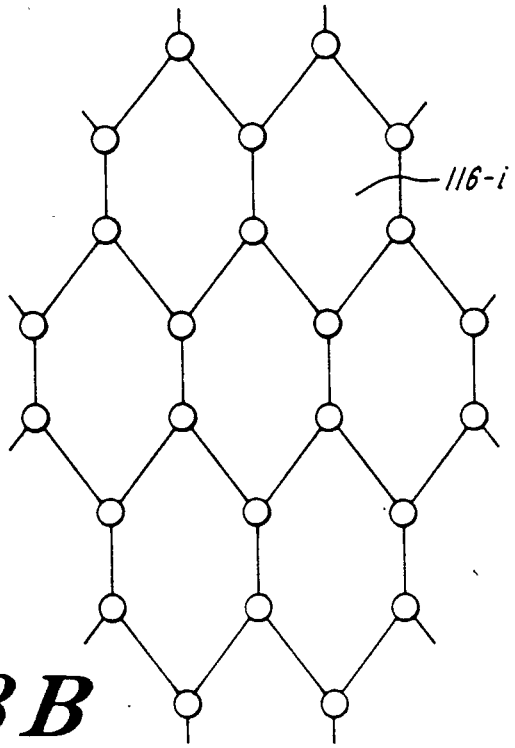

In FIG. 8A, the solid lines show the locus of "first subset" heat transfer devices for a rectangular grid of cells 116-*i*, and, in FIG. 8B, the solid lines show the locus of "first subset" heat transfer devices for a hexagonal grid of cells 116-*i*. In FIGS. 8A and 8B, only the cell vertex-defining heat transfer devices are shown (by hollow dots), but intermediately positioned devices will generally also be used. Of course, other numbers of heat transfer rods and corresponding heat transfer device arrangements can be used so long as a complete frozen bottom layer of earth is provided.

Figure 9A:
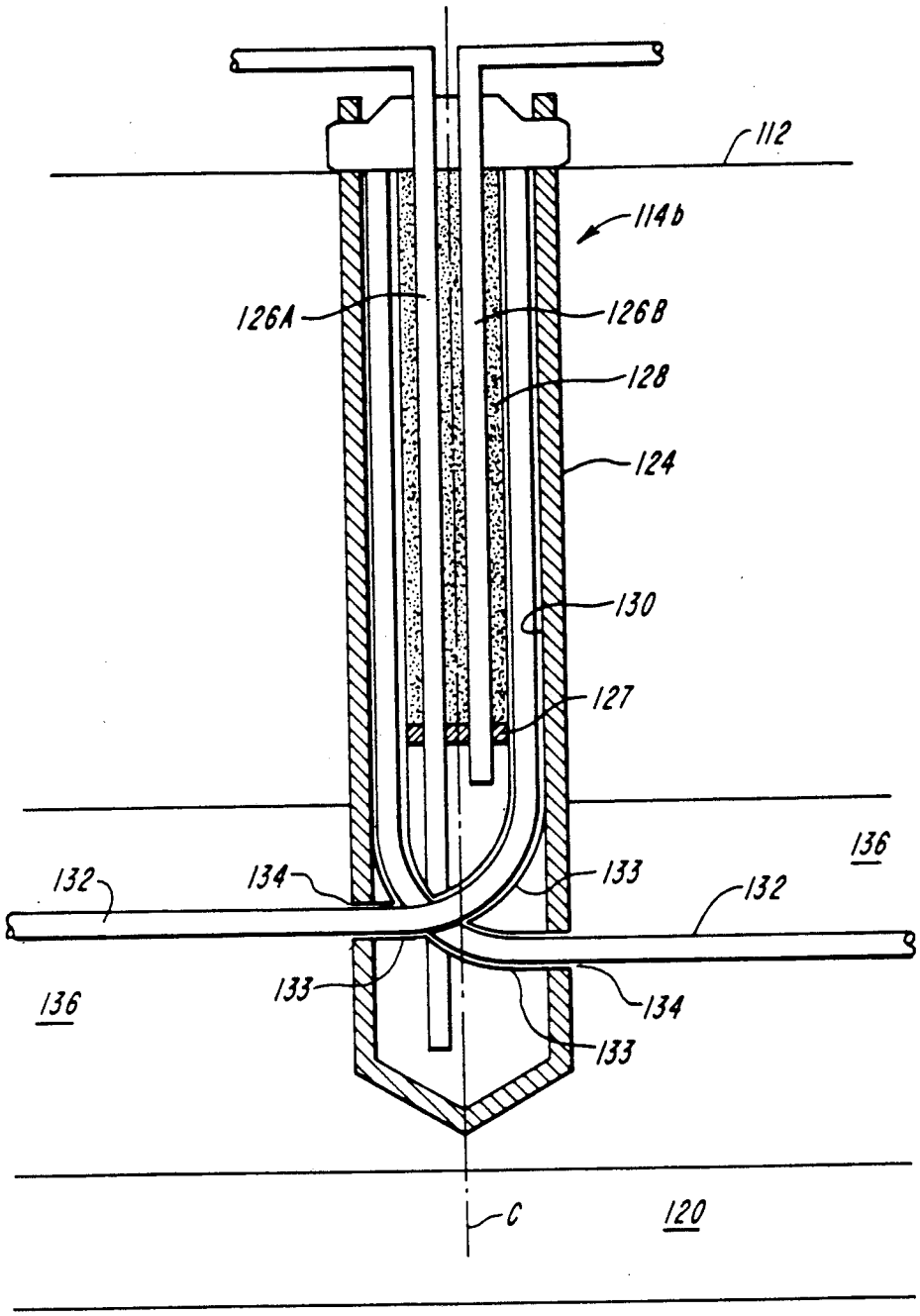
FIGS. 9A and 9B are a schematic view in section and a top view, respectively, of an alternative heat exchange device in accordance with the invention.
Figure 9B:
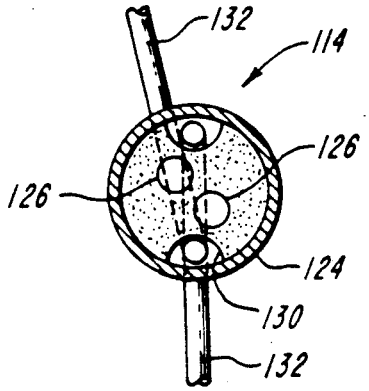

The configurations of FIGS. 7B and 7C illustrate top views of four and three heat transfer rod embodiments, respectively, where the elbow regions 133 establish relatively small radius bends in the heat transfer rods, and where the distal ends of the rods are radially directed with 90 degree and 120 degree intervals, respectively. FIGS. 9A and 9B illustrate a similar embodiment, but where two rods extend outward from opposite sides of the core 128 from the insertion axis C. With this configuration, the distal ends of the rods extend outward at an angle other than 180 degrees, and in different horizontal planes, but relatively large radius bends are established by elbow regions 133. In other configurations, a larger number of rods may be used, with the exit ports being at different axial locations along the outer casing.

In general, by establishing a relatively low temperature on the outer surfaces of heat transfer devices 114 will result in the water in the portions of the Earth adjacent to those heat transfer devices becoming frozen. In certain applications, however, there is insufficient water in these portions of the Earth to result in the predetermined volume of earth being completely frozen. Such a situation is depicted in FIG. 6A wherein a block of nine cells 116-1 through 116-9 is established and only the perimeter cells contain enough water to sustain complete freezing of the Earth. That is, the volume underlying an inner area 113 is cold but remains "unfrozen", since in this exemplary configuration, there is little or no water present. In such a situation, water can be injected (for example, by way of perforated casings driven into the volume) into that portion of the Earth having an insufficient naturally occuring water supply to sustain complete freezing. This can be done preferably after a relatively low temperature is established on the outer surface of heat transfer devices 114, to ensure that no contaminated water might escape the contaminated volume of earth 112A. In the event the region to be removed is already enclosed by an immobilizing ice wall, such as might be established by the containment form of the invention, the water might be added to earth below surface region 113 prior to lowering the temperature in the Earth below that surface region.

In still other applications, the entire predetermined volume of earth 112A may be such that there is insufficient water to support freezing. In such a situation, a relatively low temperature can be established on the outer surface of heat transfer devices 114 in order to establish low temperature columnar regions of earth which extend axially along and radially about the central axes of heat transfer devices 114. In such an application, the position of the central axes, the radii of the columnar regions, and the lateral separations of heat transfer devices 114 are selected so that adjacent low temperature columnar regions overlap and collectively fill at least the periphery of the predetermined volume to establish a low temperature composite volume of earth therein. Water is then injected into selected portions of the Earth adjacent to heat transfer devices 114 to result in a frozen volume of earth being established in the composite volume. In this manner, migration of hazardous materials is contained. Since the added water would freeze while it enters the low temperature columnar regions, there is no danger that any of that water would escape.

Once a cell 116 has been completely frozen in one of the manners discussed above, it is ready to be removed from its in situ position. For this purpose, lifting elements 118 (denoted by hollow dots with vertical stems in FIG. 6A) are inserted into the cell 116. In the preferred form, the lifting elements include a loop portion to allow a lifting force to be applied thereto and a stem portion extending into and anchored to the cell. To avoid the problem of drilling waste which might be contaminated and is difficult to dispose of, lifting elements 118 are adapted to be either driven or screwed into cell 110. Once lifting elements 118 are in place and the cell 116 has been frozen, a relatively high temperature is established on the outer surface of heat exchange elements of the first subset 114*a* so that the water in the portions of the Earth adjacent to these heat transfer devices and along the lateral surfaces of cell 116 is substantially unfrozen. This step will free cell 116 from the cells surrounding it so that it can be lifted from its in situ position.

Figure 10:
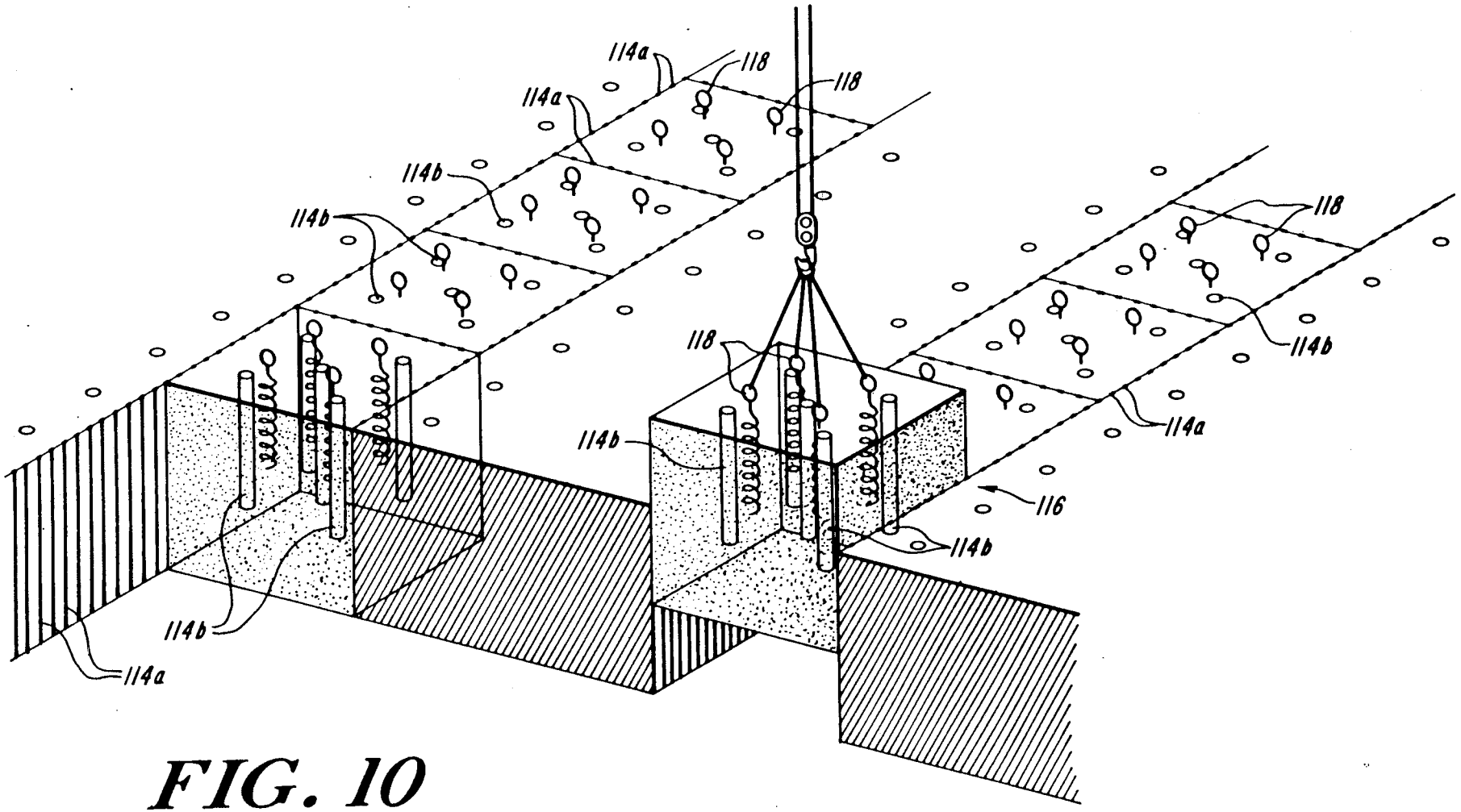
FIG. 10 is a perspective view of a portion of the confinement system of FIG. 6 during removal of a cell.

Once the water in the portions of the Earth along the lateral surfaces of cell 116 has been unfrozen, a lifting force is applied to lifting elements 118 and cell 116 is partially removed from its in situ position as depicted in FIG. 6B and in FIG. 10. Cell 116 is held in this position for a period of time sufficient to allow the water on the lateral surfaces thereof to refreeze. In this position, a relatively low temperature is established on the outer surface of the heat transfer devices included in the removed cell 116 to facilitate complete refreezing of the water contained therein. Additionally, a water spray can be applied to the lateral surfaces of cell 116 to establish an ice glaze thereon in order to prevent hazardous material on the cell periphery from becoming windborne.

Once cell 116 is completely frozen, it can be fully removed from its in situ position and is ready for transportation to a site suitable for storage or remediation of the harzardous material contained in the cell. For facilitating transportation of the removed cell 116, in one embodiment of the invention, the removed cell is placed in a substantially flat bottom container having liquid phase water therein. The frozen cell 116 is left in the container long enough for a substantially flat bottom of ice to form on the bottom of cell 116. Similar shaping of the cell surfaces may be achieved for the other cell surfaces as desired, for example, to establish rectangular "blocks" suitable for stacking.

The overall operation of the invention in either the containment or removal forms is preferably computer controlled in a closed loop in response to condition signals from the various sensors. In a typical installation, the heat flow conditions are monitored during the start-up mode of operation, and appropriate control algorithms are derived as a start point for the maintenance mode of operation. During such operation, adaptive control algorithms provide the desired control.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A method for reversibly freezing a predetermined volume extending downward beneath a surface region of the Earth, and for establishing, and removing at least one substantially frustum-shaped cell extending downward from said surface region and within said volume, the method comprising the steps of:

A. establishing an array of elongated heat transfer devices extending downward from spaced-apart locations throughout said surface region, said array including a first subset of said devices positioned on the lateral surfaces of said cell, and including a second subset of said devices positioned at least within said cell, B. establishing a relatively low temperature on the outer surface of said heat transfer devices of said second set, whereby the water in the portions of the Earth adjacent to said heat transfer devices of said second set freezes to establish ice columns extending axially along and radially bout the central axes of said heat transfer devices of said second set, wherein the position of said central axes, the radii of said columns, and the lateral separations of said heat transfer devices of said second set are selected so that adjacent columns overlap, said overlapping columns collectively filling at least the periphery of said cell to establish a frozen volume substantially containing at least the Earth therein, C. establishing a relatively high temperature on the surface of said heat transfer devices of said first set, whereby the water in the portions of the Earth adjacent to said heat transfer devices of said first set and along the lateral surfaces of said cell is substantially unfrozen, said unfrozen portions of the Earth defining the lateral surfaces of said cell, D. removing said cell from said volume by lifting said cell from its in situ position in said volume.

2. The method of claim 1 wherein said removing step includes the substep of applying a water spray to the lateral surfaces of said cell, thereby establishing an ice glaze on the outer surface of said removed cell.

3. The method of in claim 1 comprising the further step of:

positioning said removed cell in a substantially flat bottomed container having liquid phase water therein, whereby said water freezes to the bottom of said cell, thereby establishing a substantially flat bottom on the composite of said cell and said water.

4. The method of claim 1 further comprising the step of:

injecting water into selected portions of the Earth adjacent to said second subset of heat transfer devices.

5. The method of claim 4 wherein the step of injecting water into selected portions of the Earth adjacent to said second subset of heat transfer devices is carried out prior to said low temperature establishing step.

6. The method of claim 4 wherein the step of injecting water into selected portions of the Earth adjacent to said second subset of heat transfer devices is carried out after said low temperature establishing step.

7. The method of claim 1 wherein said removal step comprises the substeps of:

A. inserting lifting elements into said cell prior to lifting said cell, each of said lifting elements establishing a point at which a substantially vertical force may be externally applied, B. applying external forces to said lifting elements, whereby said cell is separated and lifted from said volume.

8. The method of claim 7 wherein said inserting step is carried out prior to said relatively low temperature establishing step.

9. The method of claim 7 wherein said inserting step is carried out after said relatively low temperature establishing step.

10. The method of claim 7 wherein said lifting elements include a force receiving portion adapted to receive said external forces, and an anchor portion adapted to rigidly couple said force receiving portion to said cell, and wherein said inserting step includes inserting said anchor portion into said cell by one of the group consisting of driving and screwing said anchor portions.

11. The method of claim 1 wherein said array establishing step includes the substep of establishing said second subset of said heat transfer devices, whereby at least some of said devices of said second subset are positioned outside said cell.

12. A method for reversibly freezing a predetermined volume extending downward beneath a surface region of the Earth, and for establishing, and removing at least one substantially frustum-shaped cell extending downward from said surface region and within said volume, the method comprising the steps of:

A. establishing an array of elongated heat transfer devices extending downward from spaced-apart locations throughout said surface region, said array including a first subset of said devices positioned on the lateral surfaces of said cell, and including a second subset of said devices positioned at least within said cell, B. establishing a relatively low temperature on the outer surface of said heat transfer devices of said second set, to establish low temperature columns of earth which extend axially along and radially about the central axes of said heat transfer devices of said second set, wherein the position of said central axes, the radii of said columns, and the lateral separations of said heat transfer devices of said second set are selected so that adjacent low temperature columns overlap, said overlapping low temperature columns collectively filling at least the periphery of said cell to establish a low temperature composite volume of earth therein, C. injecting water into selected portions of the Earth adjacent to said second subset of heat transfer devices resulting in a frozen volume of earth being established at least at the periphery of said cell;

D. establishing a relatively high temperature on the surface of said heat transfer devices of said first set, whereby the water in the portions of the Earth adjacent to said heat transfer devices of said first set and along the lateral surfaces of said cell is substantially unfrozen, said unfrozen portions of the Earth defining the lateral surfaces of said cell, E. removing said cell from said volume by lifting said cell from its in situ position in said volume.

13. the method of claim 12 wherein said removing step includes the substep of applying a water spray to the lateral surfaces of said cell, thereby establishing an ice glaze on the outer surface of said removed cell.

14. The method of in claim 12 comprising the further step of:

positioning said removed cell in a substantially flat bottomed container having liquid phase water therein, whereby said water freezes to the bottom of said cell, thereby establishing a flat bottom on the composite of said cell and said water.

15. The method of claim 12 wherein said removal step comprises he substeps of:

A. inserting lifting elements into said cell prior to lifting said cell, each of said lifting elements establishing a point at which a substantially vertical force may be externally applied, B. applying external forces to said lifting elements, whereby said cell is separated and lifted from said volume.

16. The method of claim 15 wherein said inserting step is carried out prior to said relatively low temperature establishing step.

17. The method of claim 15 wherein said inserting step is carried out after said relatively low temperature establishing step and before the step of injecting water into portions of the Earth adjacent said second subset of heat transfer devices.

18. The method of claim 15 wherein said inserting step is carried out after the step of injecting water into portions of the Earth adjacent said second subset of heat transfer devices.

19. The method of claim 15 wherein said lifting elements include a force receiving portion adapted to receive said external forces, and an anchor portion adapted to rigidly couple said force receiving portion to said cell, and wherein said inserting step includes inserting said anchor portion into said cell by one of the group consisting of driving and screwing said anchor portions.

20. The method of claim 12 wherein said array establishing step includes the substep of establishing said second subset of said heat transfer devices, whereby at least some of said devices of said second subset are positioned outside said cell.

21. An Earth-freezing apparatus comprising:

A. a relatively high thermal conductivity, elongated tubular element extending along a reference axis and having a relatively high thermal conductivity, solid central core within said tubular element, said tubular element and central core both having a proximal end and a distal end, B. a continuous central channel extending within said central core from said proximal end to a point near said distal end and from said point to said proximal end, said central channel being adapted to accommodate a flow of a heat exchange fluid therethrough, C. at least one substantially uniform cross-section heat transfer rod guide channel extending within said central core from said proximal end to an exit point between said proximal end and said distal end, said guide channel extending along a guide axis, said guide axis being substantially parallel to said reference axis at said proximal end and being angularly offset with respect to said reference axis at said exit point, whereby the walls of said channel are adapted to receive an elongated metal rod inserted from said proximal end and driven therethrough along said guide axis, whereby the leading tip of said rod exits in part from said core at said exit point.

22. An Earth-freezing apparatus as set forth in claim 21 comprising at least two substantially uniform cross-section heat transfer rod guide channels extending within said central core from said proximal end to first and second exit points between said proximal end and said distal end, said guide channels extending along guide axes, said guide axes being substantially parallel to said reference axis at said proximal end and being angularly offset with respect to said reference axis at said first and second exit points, whereby the walls of each of said channels are adapted to receive an elongated metal rod inserted from said proximal end and driven therethrough along said guide axis, whereby the leading tip of each of said rods exits in part from said core at one of said first and second exit points.

23. An Earth-freezing apparatus as set forth in claim 22 wherein said first and second exit points are displaced from one another in the axial direction.

24. An Earth-freezing apparatus according to claim 21 wherein said tubular element and said central core are discrete elements.

* * * * *